United States Patent [19]

Stockman

[11] 4,372,370

[45] Feb. 8, 1983

[54] ROTOR SUPPORT

[75] Inventor: Richard F. Stockman, Friendship, N.Y.

[73] Assignee: The Air Preheater Company, Inc., Wellsville, N.Y.

[21] Appl. No.: 294,258

[22] Filed: Aug. 19, 1981

[51] Int. Cl.[3] ..... F28D 19/00

[52] U.S. Cl. ..... 165/8; 165/67

[58] Field of Search ..... 165/8, 9, 67, 68

[56] References Cited

U.S. PATENT DOCUMENTS 3,192,999 7/1965 Stockman ..... 165/9

*Primary Examiner*—Albert W. Davis, Jr.

*Attorney, Agent, or Firm*—William W. Habelt

[57] ABSTRACT

Rotary regenerative heat exchange apparatus having a rotor carrying a mass of heat absorbent element that is alternately exposed to hot and cold fluids. Heat from the hot fluid is first transferred to the cool element, and upon rotation of the rotor is then transferred to the cool fluid flowing therethrough. The rotor and rotor housing that encloses the rotor are supported separately upon independent columns whereby there can be no transmission of force therebetween to induce sympathetic distortion of either the rotor or the rotor housing.

4 Claims, 1 Drawing Figure

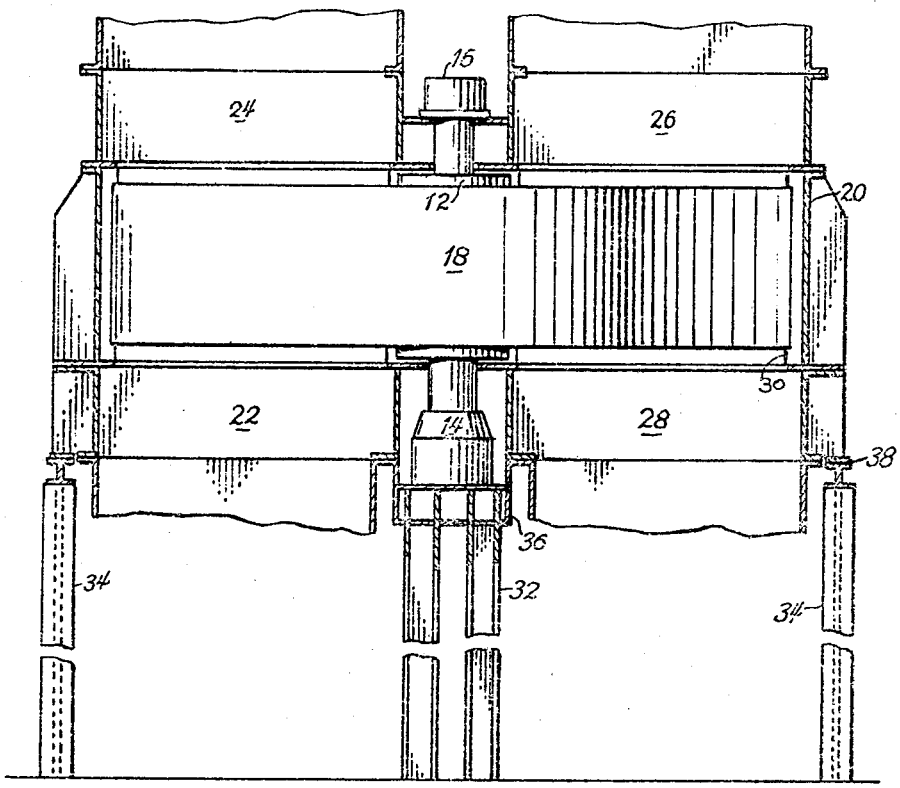
15
24
26
12
20
18
30
22
14
28
38
36
34
32
34

ROTOR SUPPORT

BACKGROUND OF THE INVENTION

In rotary regenerative heat exchange apparatus a mass of heat absorbent element commonly comprised of packed element plates is first positioned in a hot gas passageway to absorb heat from the hot gases passing therethrough. After the plates become heated by the hot gases they are moved, frequently by rotation, into a passageway for a cool air where the then hot plates transmit their heat to the cool air or other fluid passing therethrough.

The heat absorbent element is usually carried by a cylindrical rotor that rotates between hot and cool fluids, while a fixed housing including sector plates at opposite ends of the rotor is adapted to surround the rotor and maintain the hot and cool fluids in separate ducts. To prevent mingling of the two fluids, the end edges of the rotor are usually provided with flexible sealing members that are intended to rub against the adjacent surface of the rotor housing to resiliently accommodate a limited degree of "turndown" or other distortion caused by thermal deformation and mechanical loading of the heat exchanger as brought about by temperature variation and normal bending stress caused by the force of gravity.

Originally the rotor and surrounding housing structure were relatively small and were accordingly supported solely by ductwork that directed the fluids to and from the heat exchanger. As the size of this type of apparatus was increased, the rotor was mounted on a bearing which was in turn carried by a horizontal support beam, either above or below the rotor. The housing was later supported directly or indirectly from the same beam whereby thermal and mechanically induced distortion of the beam would induce relative movement of the rotor and surrounding housing structure to allow leakage of fluid therebetween. Then, as the size of the apparatus was increased further, the weight of the rotor and surrounding housing structure was also increased so that a heavier support beam was required to preclude still more distortion; but, for large units as currently being provided, a heavy horizontal support beam and massive connecting plate structure is deemed essential to support the rotor and its surrounding housing.

Sealing means between the rotor and surrounding housing structure have been improved greatly to close the leakage paths therebetween, but in heat exchange apparatus of the rotary regenerative type there still exists excessive leakage that lowers the operating efficiency of the apparatus. Moreover, any reinforcement or stiffeners added to the rotor and rotor housing to preclude distortion necessarily add to the size and weight of the heat exchanger thus tending to produce still more distortion in the manner above cited. This produces still more fluid leakage, a lower efficiency, and increased operating costs.

Description of the Prior Art. Patents have been granted for rotary regenerative heat exchange apparatus having various arrangements that support a rotor and its surrounding housing structure so there will be a minimum amount of relative deflection therebetween.

U.S. Pat. No. 2,224,787 of Horney, U.S. Pat. No. 3,155,152 of Conde, and U.S. Pat. No. 3,874,442 of Johnsson are examples of apparatus wherein a central support beam is mounted at the top of the rotor to support both the rotor and the rotor housing. In U.S. Pat. No. 2,352,717 of Karlsson and U.S. Pat. No. 3,802,489 of Kirchoff et al, the rotor housing is supported at the bottom, the rotor in turn being supported by the housing structure.

In various other patents such as U.S. Pat. No. 3,016,231 of Muller, the exact support mechanism is not germane to the invention so it is not further disclosed. However, it should be assumed that in the absence of a valid teaching, all apparatus is supported by conventional support means.

For most applications it may also be assumed that the apparatus disclosed is for average sized units of less than 100,000 to 200,000 pounds. However, a heat exchanger according to this invention by comparison may have an overall weight of from one to two million pounds, of which the rotor may comprise three-fourths of the total weight while the rotor housing and support therefor will comprise the remaining portion of the total weight. It is thus apparent that when transmitted to a transverse support beam, these forces would effect a severe bending that when considered with the deflection caused by thermal distortion and weight of the beam itself would create an amount of relative movement between the rotor and surrounding housing that would be difficult, if not impossible, to properly contain or control. Therefore, fluid leakage from the apparatus would remain untenable.

SUMMARY OF THE INVENTION

The invention is therefore directed to a unique support arrangement that carries the rotor of a regenerative heat exchanger completely independent from the supports that carry the surrounding rotor housing. The supports for both the rotor and the enclosing housing structure are entirely independent from one another since they bear compressively upon vertical supports that extend down to independent ground bearing structure. Therefore, movement of either the rotor or the rotor structure will not effect a sympathetic movement therebetween to vary the sealing relationship.

BRIEF DESCRIPTION OF THE DRAWING

The single FIGURE is a cross-sectional view of a rotary regenerative heat exchanger involving the present invention.

DESCRIPTION OF THE PREFERRED EMBODIMENT

In the arrangement of the invention a rotary regenerative air preheater includes a rotor 18 having a central rotor post 12 mounted on a support bearing 14 and guided at its upper end by a guide bearing 16 that enables the rotor to be rotated about its vertical axis by conventional means not here illustrated. The rotor includes a cylindrical shell concentrically formed around the rotor post and adapted to carry a mass of heat absorbent material that is alternately exposed to the streams of heating fluid and the fluid to be heated. The heat absorbent material of the rotor is usually carried in a series of sector shaped baskets arranged in juxtaposition, with a housing 20 adapted to surround the rotor to contain the several fluids. The housing is in turn provided with an inlet duct 22 for heating fluid and an outlet duct 24 for cooled fluid that has traversed the heat exchanger, while an inlet duct 26 for fluid to be heated and an outlet duct 28 for heated fluid is provided at the opposite end of the housing. This arrangement permits hot and cold fluids to flow simultaneously through the heat exchange material carried at opposite sides of the rotor.

Sealing means in the form of flexible leaf seals 30 are usually provided at opposite ends of the rotor to rub against adjacent housing structure and thus preclude fluid leakage from their respective ducts. However, mechanical deflection and thermal distortion of the rotor and the rotor housing frequently combine to make customary sealing arrangements entirely ineffective.

In the past the rotor has frequently been supported by the rotor housing itself. Then, as the size of the apparatus was increased it was deemed necessary to provide special support structure in the form of horizontal beams from which both the rotor and the rotor housing would depend. As the size of the apparatus was increased still further, larger and heavier support beams were required in addition to reinforced connecting plates to which the housing was connected. These beams and connecting plate structure account for a large portion of the total weight involved.

In accordance with this invention I provide an independent support column 32 subjacent the support bearing 14, and a plurality of diametrically spaced support pedestals 34 subjacent the housing 20. These support pedestals for the housing and the support column for the rotor extend vertically down to a ground supported base whereby they are completely independent from one another. Thus there is no sympathetic bending of one support in response to the weight or thermal deflection of the other. Support column 32 may be adapted to carry the radially adjacent portions of the fluid ductwork, while housing support pedestals 34 may be adapted to carry the ducting adjacent thereto, but such duct structure is relatively light inasmuch as it is designed to contain the fluids only, not to support the rotor housing. Moreover, the compression of column 32 and pedestals 34 is insignificant when compared to the deflection of the usual transverse beam.

A reinforcement 36 placed on the upper end of column 32 is adapted to distribute the load of the bearing and the rotor evenly on the upper end of column 32 and provide a support for the adjacent ductwork. In addition, shims 38 of suitable size may be placed on the ends of pedestals 34 to provide a predetermined clearance between the periphery of the rotor 18 and its surrounding housing structure 20.

It has been found that when compared to a size 33 air preheater of the type currently being manufactured, this apparatus provides a savings of approximately 100,000 pounds, an amount that equates to a financial savings of about $100,000.00. Moreover, inasmuch as there is much less relative deformation between the rotor and surrounding housing structure, there also is less fluid leakage, so operating effectiveness of the heat exchanger is greatly enhanced.

I claim:

1. A rotary regenerative heat exchange apparatus having a rotor including an upright rotor post and a concentric rotor shell spaced therefrom to provide an annular space therebetween, a mass of heat absorbent material carried in the annular space between the rotor post and the rotor shell, a housing surrounding the rotor in spaced relation thereto, spaced ducts at opposite ends of the rotor adapted to provide inlet and outlet ducts for a heating fluid and for a fluid to be heated, a support bearing supporting the rotor post for rotation of the rotor post and concentric rotor shell about its vertical axis, means for rotating the rotor about is vertical axis, as support column adapted to carry the support bearing, and a plurality of support pedestals subjacent the housing, said support pedestals for the housing being structurally independent from the support column for the rotor whereby the rotor housing will effect a compressive force upon each pedestal independent from the compressive force of the rotor upon the support column thereby precluding sympathetic movement therebetween.

2. A rotary regenerative heat exchange apparatus as defined in claim 1 wherein the support column for the rotor and the support pedestals for the rotor housing extend vertically downward therefrom.

3. A rotary regenerative heat exchange apparatus as defined in claim 1 wherein the support pedestals for the housing are disposed diametrically at opposite ends of the rotor housing.

4. A rotary regenerative heat exchange apparatus as defined in claim 1 including hanger means bearing on the support pedestals and the support column that carry adjacent inlet and outlet ducts therebetween.

* * * * *